United States Patent [19]

Honda

[11] 4,011,566

[45] Mar. 8, 1977

[54] IN-LINE COAX-TO WAVEGUIDE TRANSITION USING DIPOLE

[75] Inventor: Hajime Honda, Lexington, Mass.

[73] Assignee: The United States of America as represented by the Secretary of the Air Force, Washington, D.C.

[22] Filed: July 25, 1975

[21] Appl. No.: 599,298

[52] U.S. Cl. ..... 343/785; 343/821; 333/21 R

[51] Int. Cl.[2] ..... H01Q 13/24

[58] Field of Search ..... 343/785, 821, 747, 746, 343/784, 791, 792, 793, 767, 768; 333/21 R

[56] References Cited

UNITED STATES PATENTS

| | | | |
|---|---|---|---|
| 2,823,381 | 2/1958 | Martin et al. | 343/821 |
| 2,943,275 | 6/1960 | Bittner et al. | 343/821 |
| 2,954,556 | 9/1960 | Yang | 343/784 |
| 3,030,622 | 4/1962 | Leitner et al. | 343/821 |
| 3,128,467 | 4/1964 | Lanctot | 343/785 |
| 3,226,720 | 12/1965 | Brunner et al. | 343/821 |
| 3,518,691 | 6/1970 | Hallendorff | 343/785 |
| 3,681,771 | 8/1972 | Lewis et al. | 343/821 |
| 3,750,184 | 7/1973 | Kuecken | 343/821 |

OTHER PUBLICATIONS

IEEE Transactions of Antennas and Propagation (Jan. 1972) vol. 1, AP–20, No. I, pp. 96–98.

*Primary Examiner*—Eli Lieberman
*Attorney, Agent, or Firm*—Joseph E. Rusz; Robert Kern Duncan

[57] ABSTRACT

A microwave radio frequency signal is coupled from a coaxial line to a circular waveguide by an in line, slot-fed, open-ended, dipole termination of the coaxial-line, imbedded in a low loss dielectric material in the waveguide to excite the waveguide in a $TE_{11}$ mode suitable for exciting a low backlobe dielectric rod radiator.

4 Claims, 3 Drawing Figures

IN-LINE COAX-TO WAVEGUIDE TRANSITION USING DIPOLE

RIGHTS OF THE GOVERNMENT

The invention described herein may be manufactured and used by or for the Government of the United States for all governmental purposes without the payment of any royalty.

BACKGROUND OF THE INVENTION

The field of the invention is in the microwave transmission art.

Dielectric rod antennas fed by waveguides are well known in the art. Slot feed radiating systems from coaxial lines are also known. U.S. Pat. No. 3,518,691 to patentee R. H. Hallendorff discloses a dielectric rod antenna excited by a $TE_{11}$ mode in a dielectrically loaded circular waveguide. The waveguide is excited by a current loop transition structure from a colinear, end-fire coaxial system. Other patents typical of the prior art are U.S. Pat. Nos. 3,128,467 to patentee D. H. Lanctot, 2,823,381 to patentees J. F. P. Martin et al, 2,611,869 to patentee E. O. Willoughby, and 2,465,245 to patentee F. S. Mabry.

Slot-fed dipoles are discussed in "Microwave Antenna Theory and Design" by Silver (Rad. Lab. Series, Vol. 12, McGraw-Hill Book Co.) at pages 245 through 250. The $TE_{11}$ excitation of circular waveguides is discussed at pages 260 through 262 of "Radio Engineers Handbook" 1943 edition by Terman.

SUMMARY OF THE INVENTION

A coax-to-wavelength transition is provided which is compact, does not tend to generate higher order modes (which in turn would tend to degrade the radiation characteristics of the antenna system), that is not critical in structural parameters, and in which the interchange of radiators does not appreciably affect the input VSWR.

DESCRIPTION OF THE PREFERRED EMBODIMENT

Figure 1:
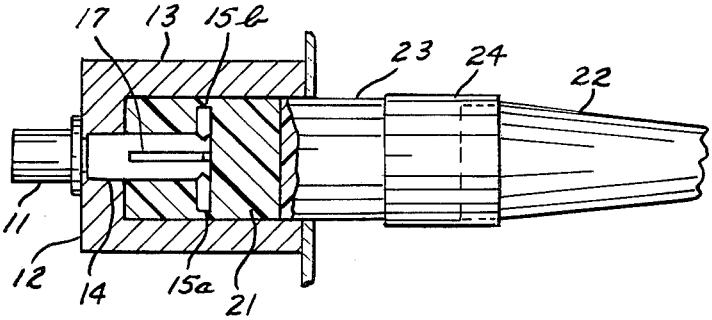
FIG. 1 is a partial section, schematic representation of the invention coupled to a dielectric rod radiator.
Figure 2:
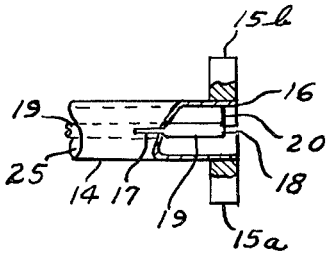
FIG. 2 is an enlarged schematic representation of the dipole and slot termination of the coaxial line.
Figure 3:
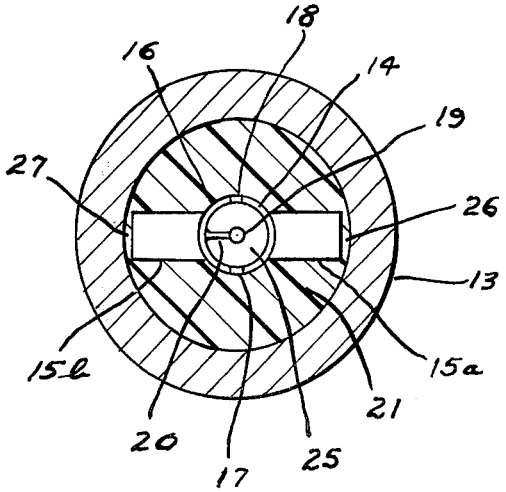
FIG. 3 is an enlarged schematic end view of the dipole and coaxial line positioned in a circular waveguide.

Referring to FIG. 1, a conventional coaxial connector 11 (such as a type N) connects with the coaxial line connecting the antenna and feed system to the associated electronic equipment. Connector 11 is mounted on the terminated end 12 of circular waveguide 13. The coax line 14 from the connector 11 may be typical Teflon filled 50-ohm coaxial line. The energy from the coaxial line is transferred to $TE_{11}$ mode in the waveguide by a slot-fed dipole having wings 15*a* and 15*b* mounted on the outer conductor 16 of the coax. (See FIG. 2). A pair of axial slots 17 and 18 are milled in the coax outer conductor in a plane normal to the dipole axis. The inner conductor 19 of the coax is short-circuited to the outer conductor 16 of the coax by the post 20 which is preferably in the line of the dipole axis. The slot-fed dipole is imbedded in the dielectric 21 filling the waveguide. The waveguide is conventionally coupled to the dielectric rod radiator 22 through the coupling elements 23 (extending into the waveguide) and 24. Stycast is the preferred dielectric material 21 in which to imbed the coax termination. Styrene and alumina may also be used as imbedding dielectrics. The coaxial line 14 feeding the dipole is conventionally loaded 25 with Teflon.

Those practicing this invention will conventionally adapt the physical sizes of the parameters in accord with the desired frequencies of operation. It is desirable that the diameter of the circular waveguide be dimensioned to support substantially only the $TE_{11}$ mode. (Typically $\lambda_o$ equal approximately 1.73 *d*.) It has been found that generally increasing the slot length, increasing the slot width, and loading the slot with dielectric, all lower the resonant frequency. Typical slot length sensitivity is approximately 100 to 125 MHz per 0.1 inch. Typical slot width sensitivity is approximately 32 to 104 MHz per 0.1 inch. In typical embodiments, Teflon loading of the slot(s) lowers the resonant frequency approximately 30 MHz. The length of the dipole is relatively insensitive; about 10 MHz maximum change with normal nominal length changes. Changing the length of the dipole will, as indicated, not shift the resonant frequency very much; it has more effect on the real component of the impedance than the reactive part. Loading the space (26 and 27) between the dipole wings (15*a* and 15*b*) and the waveguide wall slightly shifts the resonance, approximately 20 MHz is a typical value. Decreasing the position of the dipole 15*a* and 15*b* relative to the back wall 12 also tends to slightly shift the resonant frequency at a rate ranging from substantially zero to approximately 42 MHz per 0.1 inch. The dipole-to-aperture spacing has typically a sensitivity of approximately 12 to 34 MHz per 0.1 inch.

I claim:

1. A transition for coupling the end of a coaxial line, having a center conductor and an outer conductor, to a circular waveguide comprising:

a. a dipole positioned on the said outer conductor at the said end of the coaxial line;

b. a pair of axial slots positioned in the said outer conductor in a plane normal to the axis of the said dipole, extending to the end of the coaxial line;

c. means for short-circuiting the said center conductor of the said coaxial line to the said outer conductor at the said end of the coaxial line;

d. a dielectric material filling the said waveguide and positioning the said slotted end of the coaxial line and the said dipole in the said circular waveguide whereby the said slotted end of the coaxial line and the said dipole are imbedded in the said dielectric; and e. a dielectric rod antenna coupled to said circular waveguide.

2. The apparatus as claimed in claim 1 wherein the said coaxial line is a Teflon filled 50-ohm coaxial line.

3. The apparatus as claimed in claim 2 wherein the said dielectric imbedding material is Stycast.

4. A transition for coupling the end of a coaxial line, having a center conductor and an outer conductor, to a circular waveguide and exciting the circular waveguide in the $TE_{11}$ mode, the said circular waveguide having $\lambda_o$ equal approximately 1.73 times its diameter, the said transition comprising:

a. a dipole having a dipole axis positioned on the said outer conductor adjacent the said end of the coaxial line;

b. a pair of axial slots positioned in the said outer conductor in a plane normal to the axis of the said dipole, the said slots extending to the said end of the coaxial line;

c. a shorting post in the line of the dipole axis short-circuiting the said center conductor of the said coaxial line to the said outer conductor at the said end of the coaxial line;

d. an imbedding dielectric filling the said waveguide and imbedding the said slotted end of the coaxial line and the said dipole in the said circular waveguide; and e. a dielectric rod antenna coupled to said circular waveguide.

* * * * *